US009212840B2

(12) United States Patent
Mitchell et al.

(10) Patent No.: US 9,212,840 B2
(45) Date of Patent: Dec. 15, 2015

(54) APPARATUS FOR PELLETIZING ICE WITHIN A REFRIGERATOR

(75) Inventors: Alan Joseph Mitchell, Louisville, KY (US); Brent Alden Junge, Evansville, IN (US)

(73) Assignee: General Electric Company, Schenectady, NY (US)

( * ) Notice: Subject to any disclaimer, the term of this patent is extended or adjusted under 35 U.S.C. 154(b) by 495 days.

(21) Appl. No.: 12/819,244

(22) Filed: Jun. 21, 2010

(65) Prior Publication Data

US 2011/0308269 A1 Dec. 22, 2011

(51) Int. Cl.
*F25C 5/14* (2006.01)

(52) U.S. Cl.
CPC ..... *F25C 5/14* (2013.01)

(58) Field of Classification Search
CPC ..... F25C 1/147; F25C 5/046; F25C 5/12; F25C 1/045; F25C 2700/04; F25C 5/005; F25C 1/12; F25C 2400/10; F25C 1/24
USPC ..... 62/298, 320, 354, 137, 74, 347; 165/135; 425/183
See application file for complete search history.

(56) References Cited

U.S. PATENT DOCUMENTS 3,727,425 A 4/1973 Kesling
3,756,041 A 9/1973 Hanson
3,889,888 A 6/1975 Prada
4,741,137 A * 5/1988 Barratt ..... 52/314
4,741,173 A * 5/1988 Neumann ..... F25C 1/147 62/298
5,655,386 A * 8/1997 Huang et al. ..... 62/320
6,050,097 A * 4/2000 Nelson ..... F25C 5/005 62/137
7,278,275 B2 * 10/2007 Voglewede ..... F25C 5/005 241/DIG. 17
2007/0175919 A1 * 8/2007 Hortin et al. ..... 222/64
2009/0139258 A1 6/2009 Hortin
2010/0139493 A1 * 6/2010 Nevarez ..... B67D 1/0021 99/275
2011/0138836 A1 * 6/2011 Chase ..... F25C 5/005 63/320

* cited by examiner

*Primary Examiner* — Mohammad M Ali
*Assistant Examiner* — Meraj A Shaikh
(74) *Attorney, Agent, or Firm* — Dority & Manning, P.A.

(57) ABSTRACT

An apparatus and refrigerator for creating ice pellets is disclosed. The apparatus and refrigerator include a compartment, an ice storage bin positioned in the compartment and configured to store whole ice cubes therein, and a pellet ice dispenser. The pellet ice dispenser includes a first motor, a first axle drivingly connected to a shaft of the first motor, a first ice cube auger drivingly connected to the first axle, a blade downstream of the first ice cube auger and configured to shave whole ice cubes into ice pieces, and an ice pelleter. The ice pelleter includes an extrusion die disposed downstream of the blade, a shaved ice auger disposed between the blade and the extrusion die and configured to move and compress the ice pieces through the extrusion die to form pellet ice.

10 Claims, 9 Drawing Sheets

APPARATUS FOR PELLETIZING ICE WITHIN A REFRIGERATOR

BACKGROUND OF THE INVENTION

The current disclosure relates generally to refrigerators, and more specifically to apparatus for pelletizing ice within a refrigerator.

Generally, a refrigerator includes an ice maker and an ice dispensing device. Typically, the ice dispensing device can dispense whole ice cubes or crushed cubes of ice to a user's receptacle.

It is now common in the art of refrigerators to provide an ice dispenser which has the ability to dispense both whole cubes of ice and crushed cubes of ice. Crushed ice is typically created by mechanically breaking up whole cubes of ice, essentially forming smaller cubes of ice with the same density and hardness.

It is also now common for refrigerators to be configured to form ice on a surface and scrape flakes or portions of that ice off to dispense to a user. Even though these scraped flakes or portions of ice can be formed into a larger mass, since the scraped flakes or portions of ice are fractured and not compacted, they are soft and easily broken. Still other refrigerators are configured to quickly freeze small droplets of water as they fall a short distance, so that small droplets of ice may be dispensed to a user. These refrigerators typically do not have the ability to dispense whole ice cubes.

These known designs have disadvantages including the undesirability of producing smaller cubes of ice with the same density and hardness as the whole ice cubes. Other disadvantages of these known designs include the production of soft, easily broken masses which fall apart upon dispensing or use.

Thus, an ability to first produce a shaved, particulate ice product and subsequently form that shaved, particulate ice product into a pellet is desired. These pellets are not as hard as whole ice cubes and are easier for a user to chew. Also, an ability for a refrigerator to dispense either whole ice cubes or pellet ice cubes is desired.

Therefore, it would be desirable to provide an apparatus for producing ice pellets within a refrigerator that is efficient and reliable.

BRIEF DESCRIPTION OF THE INVENTION

As described herein, the exemplary embodiments of the current invention overcome one or more of the above or other disadvantages known in the art.

One aspect of the current invention relates to an apparatus. The apparatus includes a compartment, an ice storage bin positioned in the compartment and configured to store whole ice cubes therein, and a pellet ice dispenser. The pellet ice dispenser includes a first motor stationarily disposed relative to the compartment, a first axle drivingly connected to a shaft of the first motor, a first ice cube auger drivingly connected to the first axle, a blade stationarily disposed relative to the compartment and downstream of the first ice cube auger and configured to shave whole ice cubes into ice pieces, and an ice pelleter. The ice pelleter includes an extrusion die stationarily disposed relative to the compartment and disposed downstream of the blade, a shaved ice auger drivingly connected to the first axle, disposed between the blade and the extrusion die, and configured to move and compress the ice pieces through the extrusion die to form pellet ice.

Another aspect of the current invention relates to an apparatus. The apparatus includes a compartment and a pellet ice dispenser. The pellet ice dispenser includes an ice tank disposed in the compartment, a water supply configured to supply water to the ice tank, an extrusion die, a first motor stationarily disposed relative to the compartment, a first axle drivingly connected to a shaft of the first motor, an ice scraper drivingly connected to the first axle and configured to shave ice into shaved ice particles and to move and compress the shaved ice particles through the extrusion die to form pellet ice.

Yet another aspect of the current invention relates to a refrigerator. The refrigerator includes a fresh food compartment, a freezer compartment, an ice making compartment disposed in one of the fresh food compartment and the freezer compartment, a whole ice cube dispenser disposed in the ice making compartment, the whole ice cube dispenser comprising an ice storage bin configured to store whole ice cubes therein, a pellet ice dispenser disposed in the ice making compartment and configured to dispense pellet ice; and a user actuated dispensing system operative to selectively dispense whole ice cubes or pellet ice.

These and other aspects and advantages of the current invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

Figure 1:
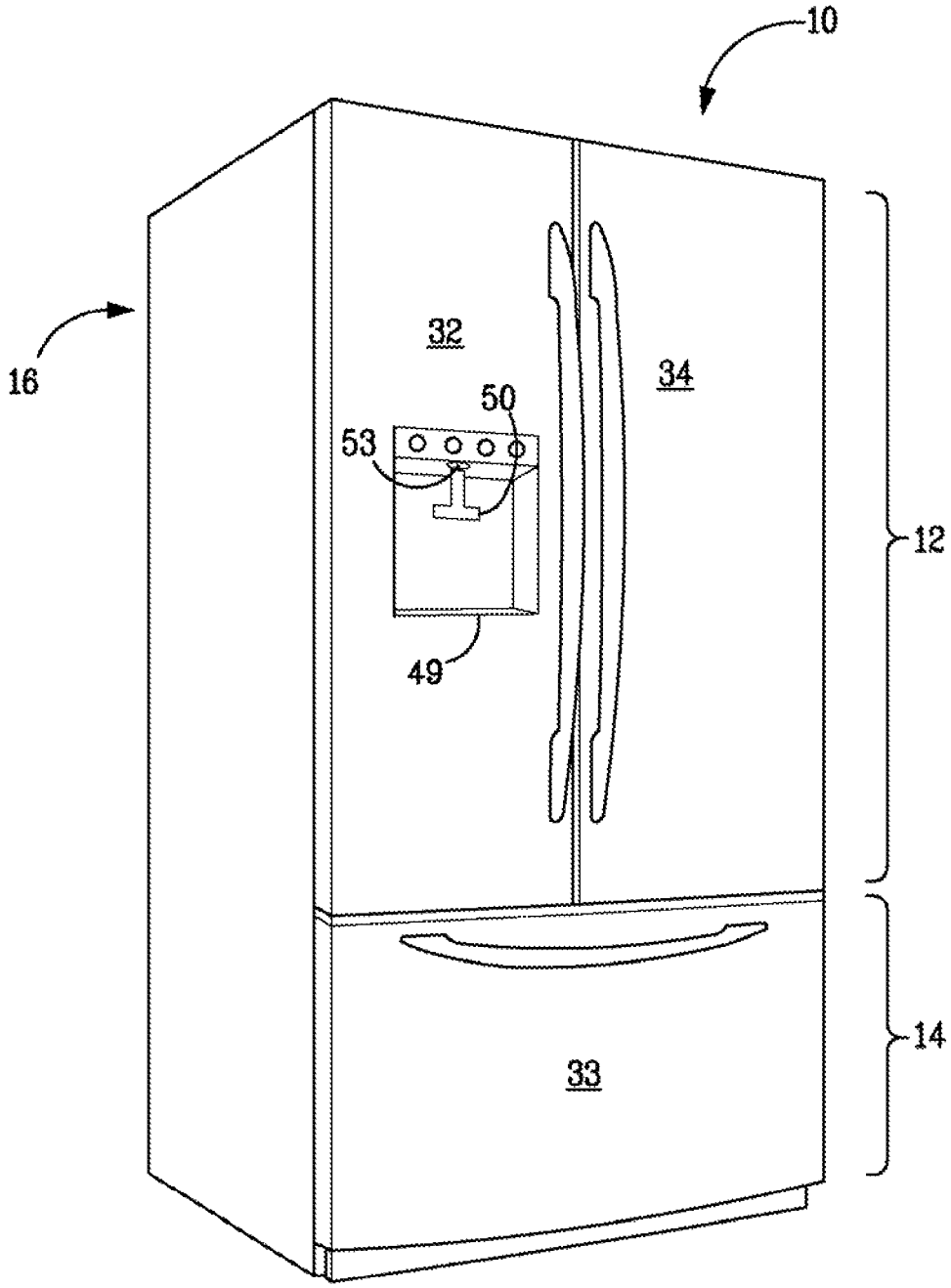
FIG. 1 is a perspective view of a refrigerator in accordance with an exemplary embodiment of the current invention.

FIG. 1 illustrates an exemplary refrigerator 10. While the embodiments are described herein in the context of a specific refrigerator 10, it is contemplated that the embodiments may be practiced in other types of refrigerators. Therefore, as the benefits of the herein described embodiments accrue generally to ice dispensing from the refrigerator, the description herein is for exemplary purposes only and is not intended to limit practice of the invention to a particular refrigeration appliance or machine, such as refrigerator 10.

On the exterior of the refrigerator 10, there is disposed an external access area 49 to receive drinking water and ice cubes. Upon a stimulus, a water dispenser 50 allows an outflow of drinking water into a user's receptacle. Upon another stimulus, an ice dispenser outlet 53 allows an outflow of whole ice cubes into a user's receptacle. Upon another stimulus, an ice dispenser outlet 53 allows an outflow of ice pellets into a user's receptacle. There are two access doors 32, 34 to the fresh food compartment 12, and one access door or drawer 33 to the freezer compartment 14. Refrigerator 10 is contained within an outer case 16.

Figure 2:
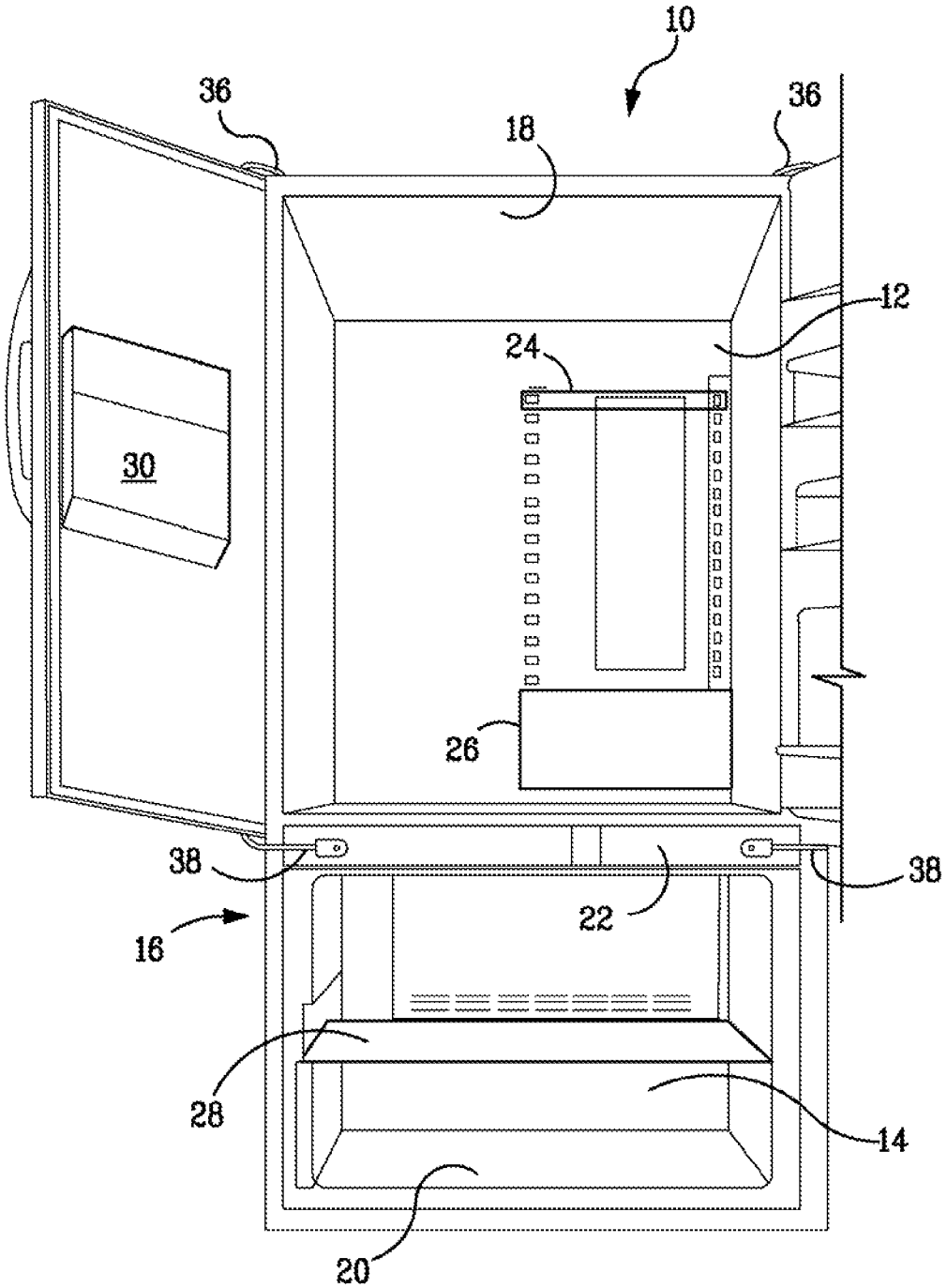
FIG. 2 is a perspective view of the refrigerator of FIG. 1 with the refrigerator doors being in an open position and the freezer door being removed.

FIG. 2 illustrates the refrigerator 10 with its upper access doors 32, 34 in the open position. Refrigerator 10 includes food storage compartments such as fresh food compartment 12 and freezer compartment 14. As shown, fresh food compartment 12 and freezer compartment 14 are arranged in a bottom mount refrigerator-freezer configuration. Refrigerator 10 includes outer case 16 and inner liners 18 and 20. A space between outer case 16 and inner liners 18 and 20, and between inner liners 18 and 20, is filled with foamed-in-place insulation. Outer case 16 normally is formed by folding a sheet of a suitable material, such as pre-painted steel, into an inverted U-shape to form top and side walls of the case. A bottom wall of outer case 16 normally is formed separately and attached to the case side walls and to a bottom frame that provides support for refrigerator 10. Inner liners 18 and 20 are molded from a suitable plastic material to form fresh food compartment 12 and freezer compartment 14, respectively. Alternatively, inner liners 18, 20 may be formed by bending and welding a sheet of a suitable metal, such as steel. The illustrative embodiment includes two separate inner liners 18, 20 as it is a relatively large capacity unit and separate inner liners add strength and are easier to maintain within manufacturing tolerances.

The insulation in the space between liners 18, 20 is covered by another strip of suitable resilient material, which also commonly is referred to as a mullion 22. Mullion 22 in one embodiment is formed of an extruded ABS material.

Shelf 24 and slide-out drawer 26 can be provided in fresh food compartment 12 to support items being stored therein. A combination of shelves, such as shelf 28, is provided in freezer compartment 14.

Access doors 32 and 34, and access door or drawer 33 close access openings to fresh food compartment 12 and freezer compartment 14, respectively. In one embodiment, each of the access doors 32, 34 is mounted by a top hinge assembly 36 and a bottom hinge assembly 38 to rotate about its outer vertical edge between a closed position, as shown in FIG. 1, and an open position, as shown in FIG. 2. For exemplary purposes, an ice making, storage and dispensing compartment 30 is shown on the interior of access door 32, inside fresh food compartment 12. Ice making, storage and dispensing compartment 30 can also be located in another location inside fresh food compartment 12 or inside freezer compartment 14. If ice making, storage and dispensing compartment 30 is inside fresh food compartment 12, it is thermally insulated relative to fresh food compartment 12, and may be cooled with, for example, cold air from freezer compartment 14 or a coolant fluid distributed throughout the refrigerator 10.

Figure 3:
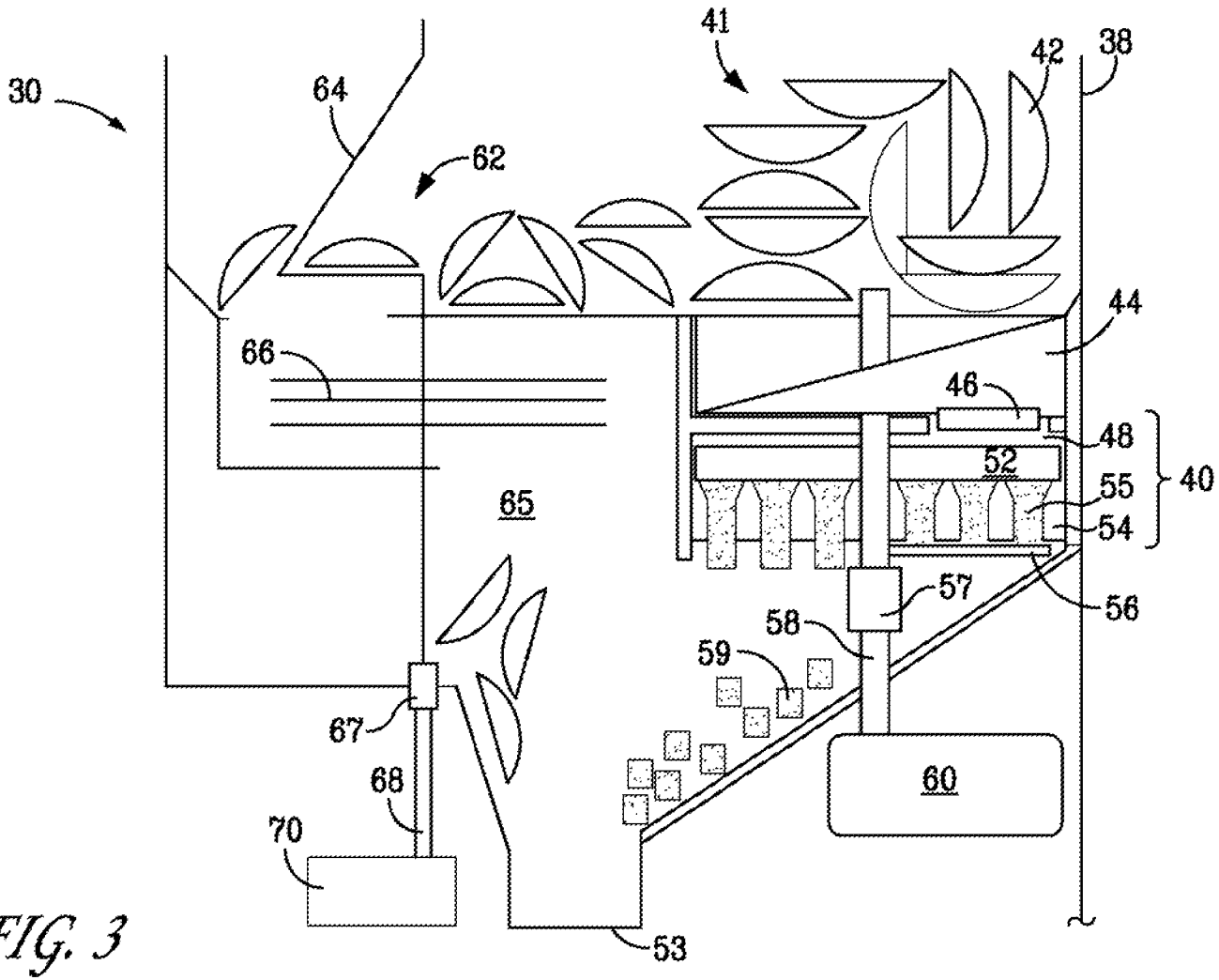
FIG. 3 is a schematic view of an interior of an exemplary ice making, storage and dispensing compartment within the refrigerator of FIG. 1.

FIG. 3 is a schematic view, showing the interior of exemplary ice making, storage and dispensing compartment 30 within refrigerator 10, whole ice cubes 42, an ice storage bin 38 and pellet ice dispenser 41. FIG. 3 further shows the pellet ice dispenser 41 including a first or whole ice cube auger 44, a blade 46, an ice pelleter 40, a first or pellet ice axle 58, a first or pellet ice motor 60 and the ice dispenser outlet 53. FIG. 3 further shows the ice pelleter 40 including a shaved ice auger 52, an extrusion die 54, and a sweep arm 56. Preferably, there is a clearance of, for example, about ⅜" to ½" between extrusion die 54 and sweep arm 56. Pellet ice axle 58 can also include a pellet ice coupler 57. Whole ice cube auger 44, shaved ice auger 52, and sweep arm 56 are drivingly connected to pellet ice axle 58, which is driven by pellet ice motor 60. Pellet ice motor 60, blade 46 and extrusion die 54 are all fixedly disposed within the ice making, storage and dispensing compartment 30.

FIG. 3 also shows a whole ice cube dispenser 62 also within the interior of exemplary ice making, storage and dispensing compartment 30. Whole ice cube dispenser 62 includes a second or vertical whole ice auger 64, sweeper blades 66, a second or whole ice axle 68 and a second or whole ice motor 70. Whole ice axle 68 can also include a whole ice coupler 67. Sweeper blades 66 and vertical whole ice auger 64 are drivingly connected to whole ice axle 68, which is driven by whole ice motor 70. Whole ice motor 70 is fixedly disposed within the ice making, storage and dispensing compartment 30.

Ice making, storage and dispensing compartment 30 can be within fresh food compartment 12 or freezer compartment 14 of refrigerator 10. Ice making, storage and dispensing compartment 30 includes the ice storage bin 38. Ice storage bin 38 can be filled with whole ice cubes through addition of whole ice cubes by a user, or ice storage bin 38 can be filled with whole ice cubes from an automatic ice maker. Whole ice cubes within ice storage bin 38 settle in the bottom portion of ice storage bin 38.

Figure 4:
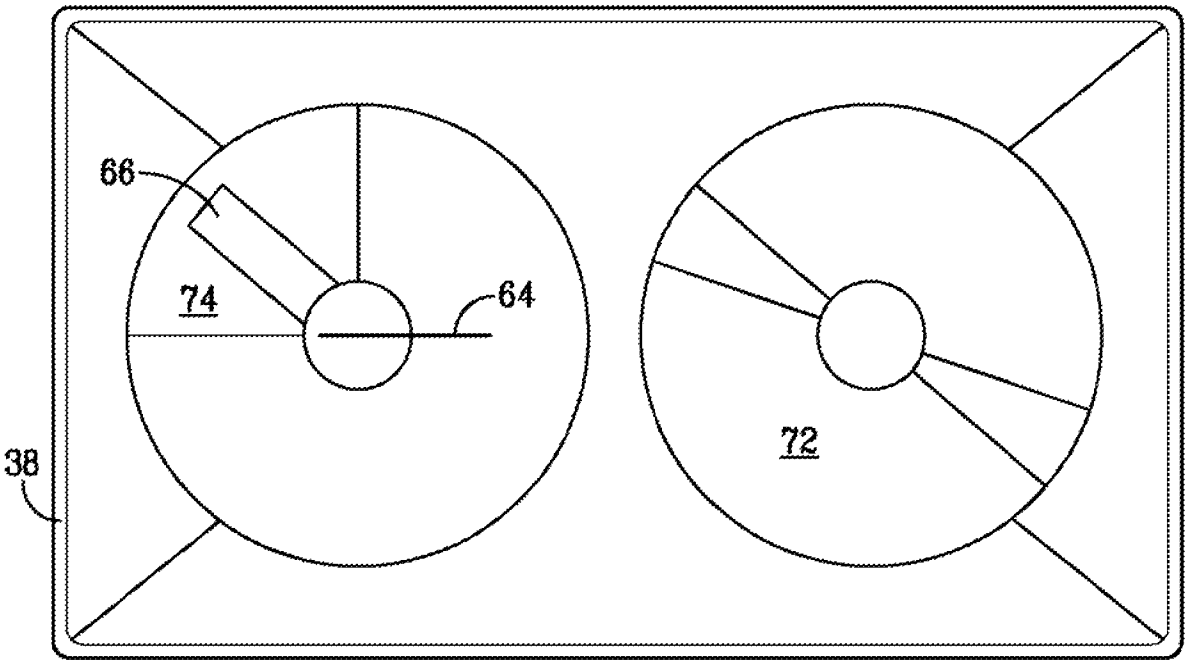
FIG. 4 is a top view of the exemplary ice making, storage and dispensing compartment, showing openings to a pellet ice dispenser and a whole ice cube dispenser.

FIG. 4 is a top view from ice storage bin 38 of the openings to pellet ice dispenser 41 and whole ice cube dispenser 62. The bottom of ice storage bin 38 is angularly configured with a slope from the sidewalls of ice storage bin 38 towards both pellet ice dispenser opening 72 and whole ice cube dispenser opening 74. Vertical, whole ice auger 64 operates to facilitate movement of whole ice cubes into whole ice cube dispenser opening 74. Sweeper blades 66 can be seen through whole ice cube dispenser opening 74.

Referring again to FIG. 3, whole ice cubes 42, stored in ice storage bin 38, enter pellet ice dispenser 41. Whole ice cubes 42 are moved from ice storage bin 38 to the blade 46 by whole ice cube auger 44. The whole ice cube auger 44 moves whole ice cubes 42 downstream towards blade 46. Blade 46 shaves whole ice cubes into small pieces of ice or particles of ice 48. Blade 46 is stationary and affixed to ice making, storage and dispensing compartment 30. Particles of ice 48 are moved downstream from below blade 48 to extrusion die 54 by shaved ice auger 52. Particles of ice 48 accumulate in a space created by the clearance between shaved ice auger 52 and extrusion die 54. Extrusion die 54 may be heated so that ice particles 48 do not adhere to the surfaces of extrusion die 54. As shaved ice auger 52 moves ice particles 48 from where they are accumulated into extrusion die 54, the ice particles 48 are compressed. As hereinafter described in greater detail with reference to FIG. 5A, ice particles 48 have a force exerted on them by shaved ice auger 52, compressing them into compressed ice particles 55 within extrusion die 54. Compressed ice particles 55 are formed into a compacted section which does not easily fall apart but is easily chewable by a user. As more and more ice particles 48 enter extrusion die 54, the compressed ice particles 55 are forced downstream towards sweep arm 56. As sweep arm 56 is rotated by pellet ice axle 58, sweep arm 56 cuts off a portion of compressed ice particles 55 which has been forced to extend beyond the lower edge of extrusion die 54. As sweep arm 56 rotates, a portion of compressed ice particle 55 is cut and drops, forming pellet ice 59. Pellet ice 59 is then ready to pass through ice dispenser outlet 53 to a user's receptacle.

Figure 5A:
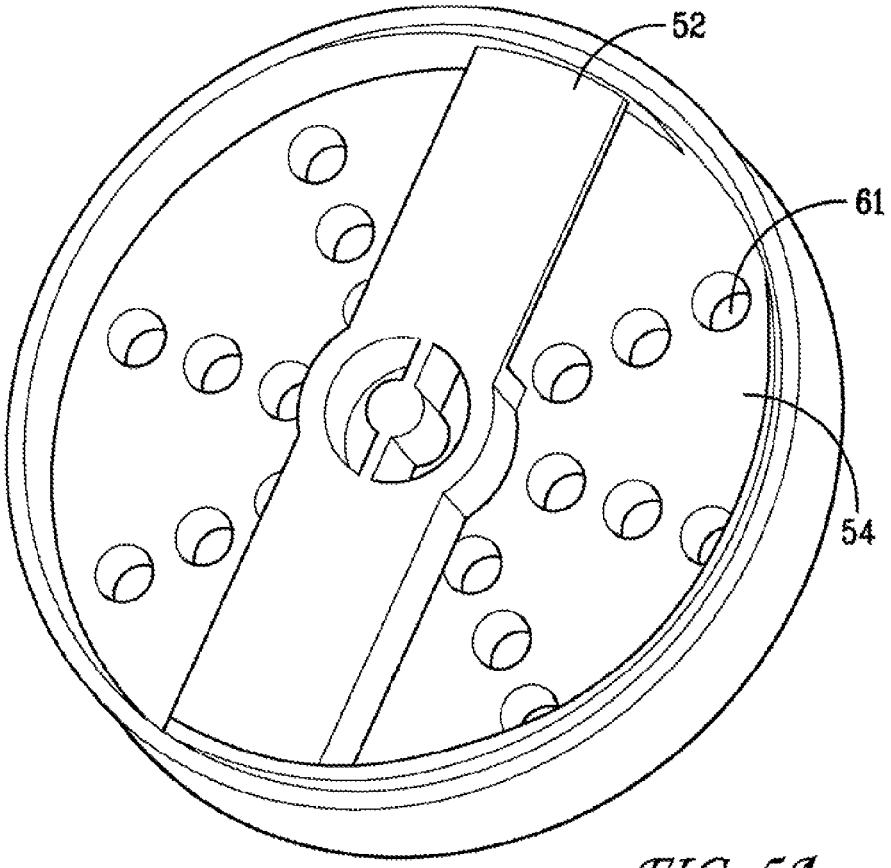
FIG. 5A is a perspective view of the topside of an extrusion die and an shaved ice auger.

FIG. 5A is a perspective view of the topside of extrusion die 54 and shaved ice auger 52 without the presence of any ice or ice particles. Under operating conditions, shaved ice auger 52 rotates and forces ice particles 48 (shown in FIG. 3) into the holes 61 of extrusion die 54, thereby forming compressed ice particles 55 (shown in FIG. 3) within the holes 61 of extrusion die 54.

Figure 5B:
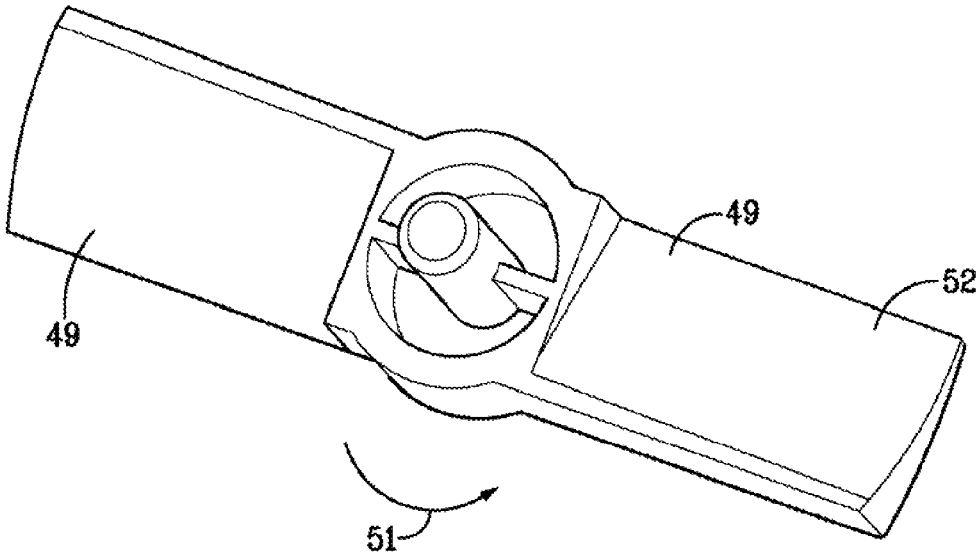
FIG. 5B is a perspective view of the underside of the shaved ice auger of FIG. 5A.

FIG. 5B is a perspective view of the underside of the shaved ice auger 52 of FIG. 5A, looking from extrusion die 54 towards whole ice cube auger 44. Shaved ice auger 52 can rotate in counter-clockwise direction 51 so that inclined faces 49 force ice particles 48 (shown in FIG. 3) into the holes 61 of extrusion die 54 (shown in FIG. 5A). Shaved ice auger 52 is driven by whole ice motor 70 in counter-clockwise direction 51 when viewed in FIG. 5B.

Referring again to FIG. 3, whole ice cubes 42, stored in ice storage bin 38 can also enter whole ice cube dispenser 62. Whole ice cubes 42 are moved from ice storage bin 38 to whole ice cube dispenser opening 74 (shown in FIG. 4) by vertical, whole ice auger 64. Once whole ice cubes 42 enter whole ice cube dispenser opening 74, they are contacted and moved by sweeper blades 66. Sweeper blades 66 facilitate the movement of whole ice cubes 42 from whole ice cube dispenser opening 74 to a lower whole ice cube dispenser opening 65 without crushing whole ice cubes 42. Once whole ice cubes 42 pass through the lower whole ice cube dispenser opening 65, they fall to ice dispenser outlet 53 and into a user's receptacle.

Figure 6:
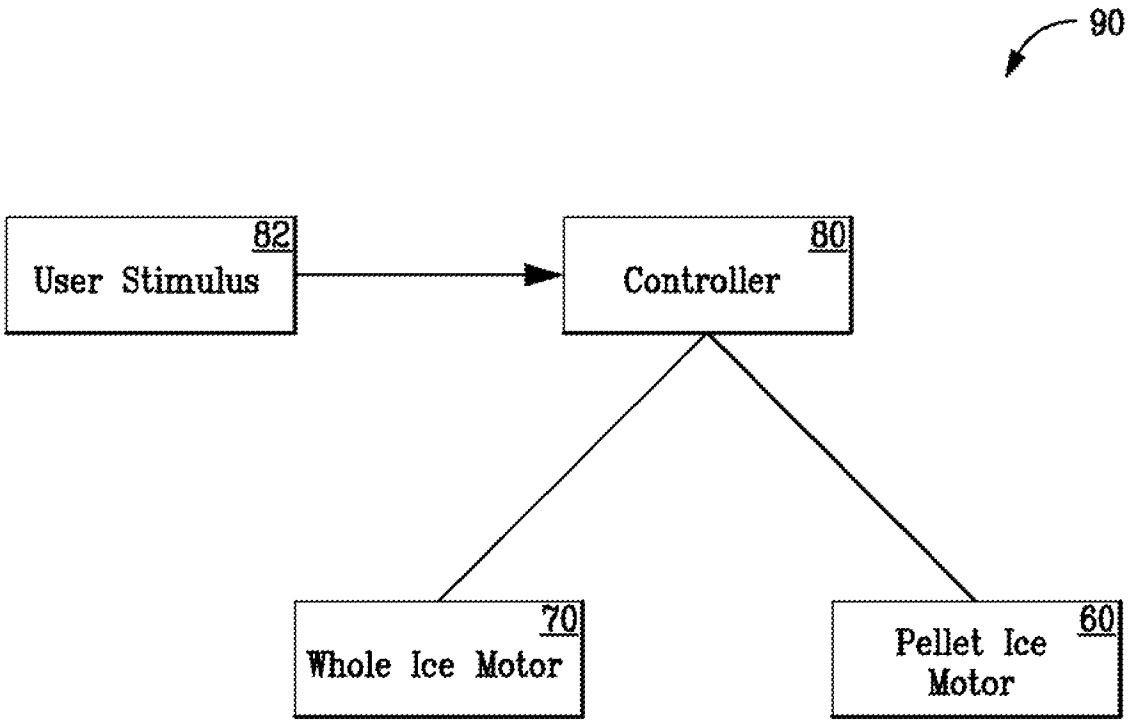
FIG. 6 is a block diagram of an exemplary ice dispenser control system.

FIG. 6 is a block diagram of exemplary ice dispenser control system 90. Ice dispenser control system 90 includes whole ice motor 70, pellet ice motor 60, a controller 80 and a user stimulus 82. The method of controlling whole ice motor 70 and pellet ice motor 60 is inputted into controller 80, for example, by programming into memory of an application specific integrated circuit (ASIC) or other programmable memory device.

Controller 80 controls the operation of whole ice motor 70 and pellet ice motor 60 based on user stimulus 82. If user stimulus 82 is a stimulus to receive whole ice cubes, whole ice motor 70 will rotate whole ice axle 68, sweeper blades 66 and vertical, whole ice auger 64 to move whole ice cubes 62 from ice storage bin 38 to ice dispenser outlet 53 (as seen in FIG. 3). If user stimulus 82 is a stimulus to receive pellet ice, pellet ice motor 60 will rotate pellet ice axle 58, ice cube auger 44, shaved ice auger 52 and sweep arm 56 to move whole ice cubes 62 from ice storage bin 38, and deliver pellet ice 59 to ice dispenser outlet 53 (as seen in FIG. 3).

Figure 7:
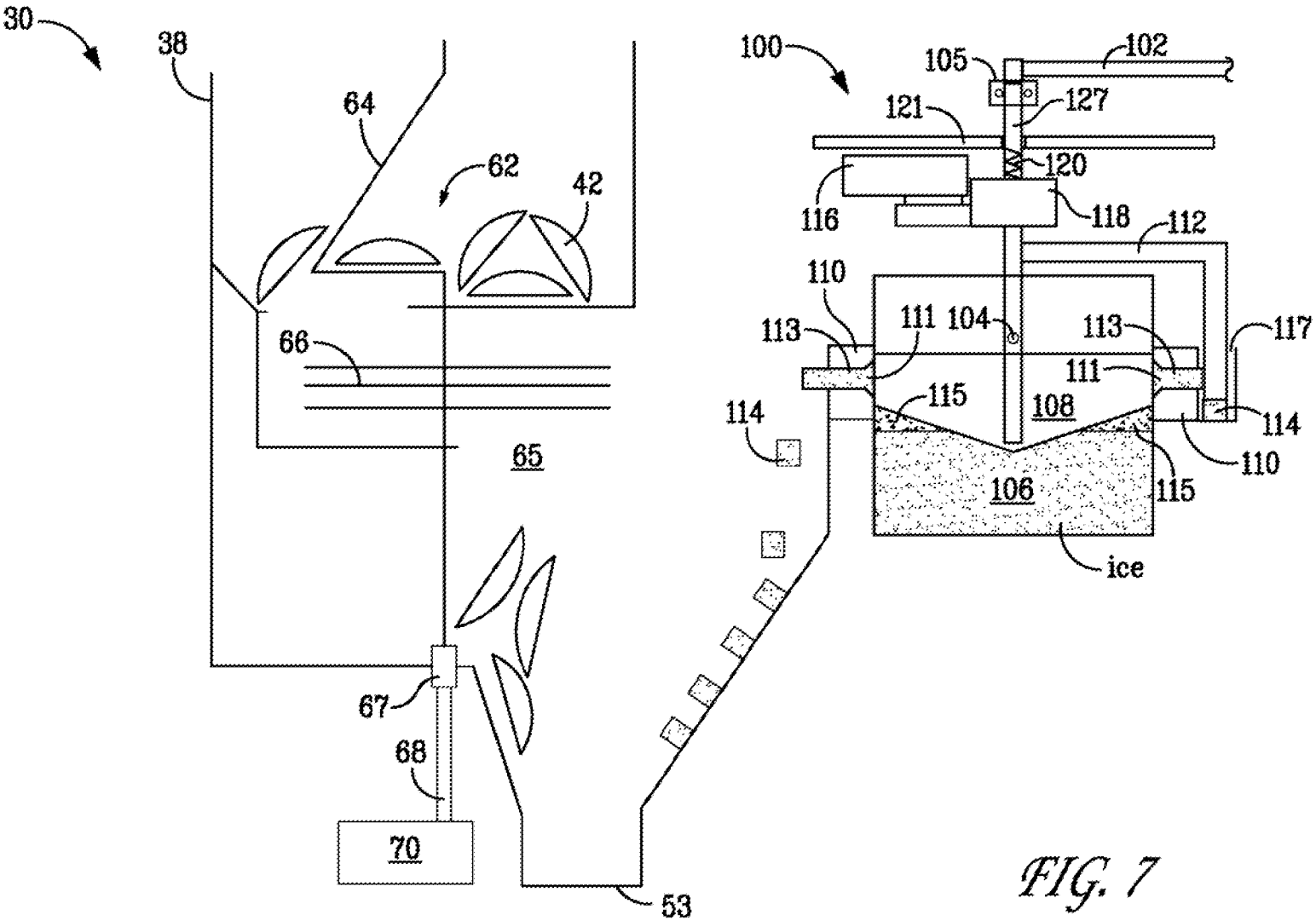
FIG. 7 is a schematic view of an interior of the exemplary ice making, storage and dispensing compartment, showing another embodiment of the pellet ice dispenser.

FIG. 7 is a schematic view of the interior of exemplary ice making, storage and dispensing compartment 30, with another embodiment of pellet ice dispenser. Whole ice cube dispenser 62 is designed to operate similarly as described above.

FIG. 7 schematically shows pellet ice dispenser 100. Pellet ice dispenser 100 includes a water supply 102, a shaved ice rotatable coupler 105, a water fill port 104, an ice tank 106, ice scraper 108 which can be, for example, in the form of a stainless blade with a sharp edge, an extrusion die 110 surrounding the ice tank 106, a shaved ice sweep arm 112, shaved pellet ice 114, a first or shaved ice motor 116, a first or shaved ice axle 127, a shaved ice gear 118, a shaved ice spring 120, shaved ice brace 121 and ice dispenser outlet 53. Ice scraper 108, shaved ice sweep arm 112, shaved ice axle 127 and shaved ice gear 118 are drivingly connected to shaved ice motor 116. Preferably, there is a clearance of, for example, about ⅜" to ½" between the extrusion die 110 and the sweep arm 112. When shaved ice brace 121 moves downward from its initial position, it compresses shaved ice spring 120, which in turn forces the shaved ice axle 127 and the ice scrapper 108 to move downward so that ice scrapper 108 engages the ice. When shaved ice brace 121 moves back to its initial position, shaved ice spring 120 expands, lifting shaved ice axle 127 and ice scrapper 108 upward so that ice scrapper 108 disengages the ice. Shaved ice brace 121 can be moved up and down by any known driving mechanism. Water supply 102 is formed of a flexible medium so that water supply 102 can bend appropriately as shaved ice axle 127 is moved up and down. Shaved ice rotatable coupler 105 connects water supply line 102 to shaved ice axle 127. Shaved ice rotatable coupler 105 is hollow and allows water from supply line 102 to pass through it towards water fill port 104.

Water is delivered to pellet ice dispenser 100 by water supply 102. Water exits water supply 102 through water fill port 104, and enters the ice tank 106. Water supply 102 remains fixedly disposed relative to ice making, storage and dispensing compartment 30 and does not rotate when shaved ice axle 127 rotates. Further water supply 102 remains connected to shaved ice rotatable coupler 105 when shaved ice axle 127 is moved up or down.

Ice tank 106 is cooled, causing delivered water to freeze. Once water in ice tank 106 freezes, ice scraper 108 can be rotated. Ice scraper 108 is rotated by shaved ice motor 116. As ice scraper 108 rotates, it scrapes the surface of ice stored in ice tank 106, creating shaved ice particles 115. As more shaved ice particles 115 are created, they accumulate and are directed towards extrusion die 110 by blade of ice scraper 108 as it is forced downward by shaved ice spring 120. In this embodiment, a cross section view of a single extrusion die 110 is shown with only two extrusion die holes 111 visible, in other embodiments, two extrusion die or several can be included. Extrusion die 110 can extend 360° circumferentially around ice tank 106, with extrusion die holes spaced along the entire circumference at predetermined intervals. The extrusion die 110 may be heated so that shaved ice particles 115 do not adhere to the surfaces of extrusion die 110. As shaved ice particles 115 pass through extrusion die 110 they form compressed, shaved ice particles 113. Compressed, shaved ice particles 113 do not easily fall apart but are easily chewable by a user. As more and more shaved ice particles 115 enter extrusion die 110, compressed, shaved ice particles 113 are forced towards shaved ice sweep arm 112. As shaved ice sweep arm 112 is rotated by shaved ice axle 127, shaved ice sweep arm 112 cuts off a portion of compressed, shaved ice particles 113 which has been forced to extend beyond the outer edge of extrusion die 110. As shaved ice sweep arm 112 rotates, a portion of compressed, shaved ice particles 113 is cut and drops, forming pellet ice 114. Pellet ice 114 either falls into shaved pellet ice bin 117 or falls towards ice dispenser outlet 53. If pellet ice 114 falls into shaved pellet ice bin 117, it is moved by shaved ice sweep arm 112, so that it also falls towards ice dispenser outlet 53 and into a user's receptacle.

In another embodiment, water and/or another liquid can be dispensed on top of solid ice in ice tank 106. Before freezing, ice scraper 108 can scrape solid ice in ice tank 106 and dispense a mixture of shaved ice particles 115 and water and/or the another liquid as a slurry of shaved ice and water. The ratio of shaved ice particles 115 to water and/or the another liquid could be adjusted by a user.

Figure 8:
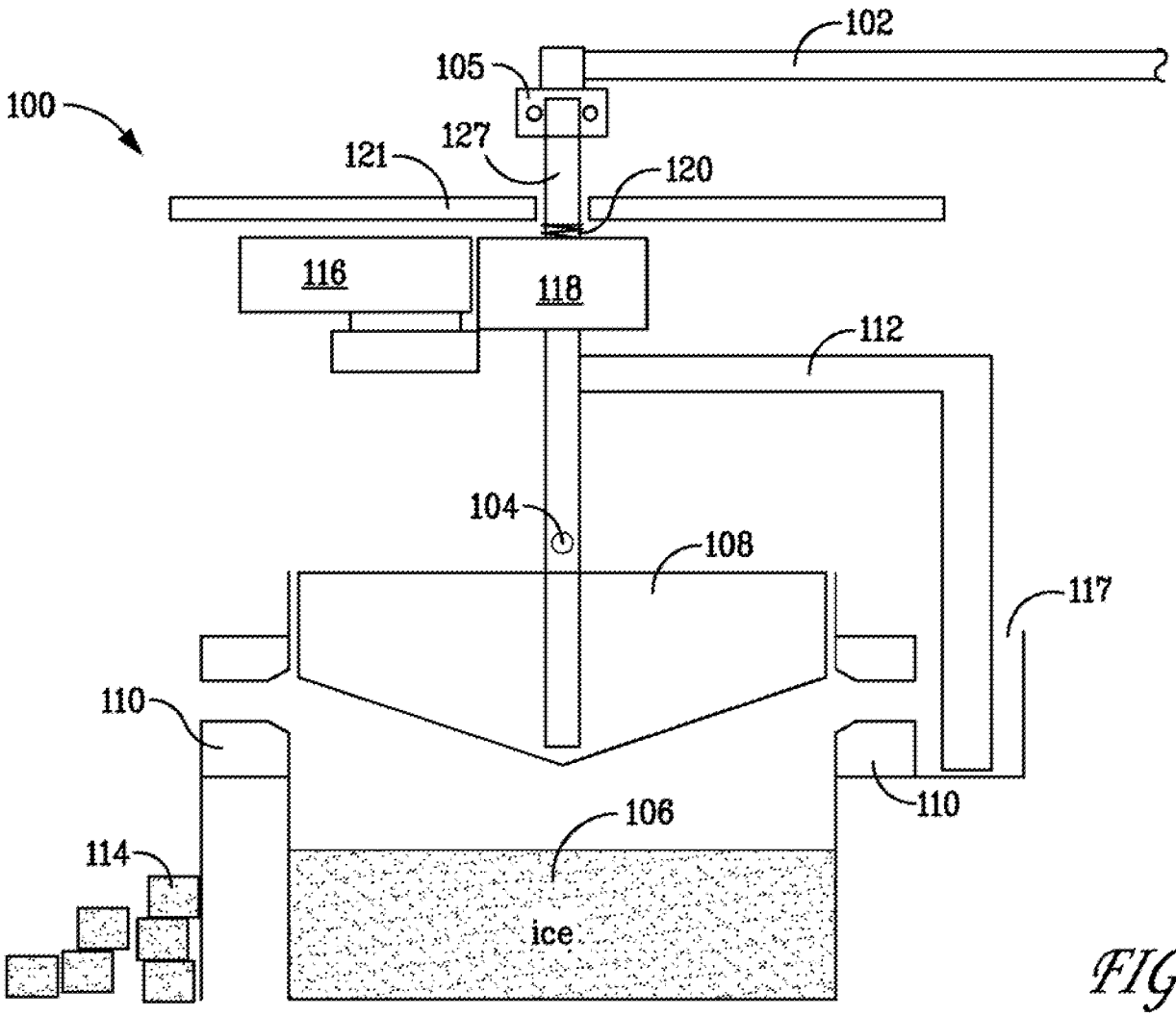
FIG. 8 is another schematic view of the pellet ice dispenser of FIG. 7, showing the ice scraper in a retracted position.

FIG. 8 is a schematic view of the interior of exemplary ice making, storage and dispensing compartment 30, with just pellet ice dispenser 100 visible. Shaved ice axle 127 is shown in the up position in FIG. 8, which lifts ice scraper 108 off of the surface of liquid or ice in ice tank 106. To move shaved ice axle 127 into this up position, mechanical force must be applied by a solenoid or a user. Moving shaved ice axle 127 into this up position compresses shaved ice spring 120 against shaved ice brace 121. Moving shaved ice axle 127 into this up position also lifts shaved ice gear 118, so that the teeth of shaved ice gear 118 passes by and disengages the teeth shaved ice motor 116.

Figure 9:
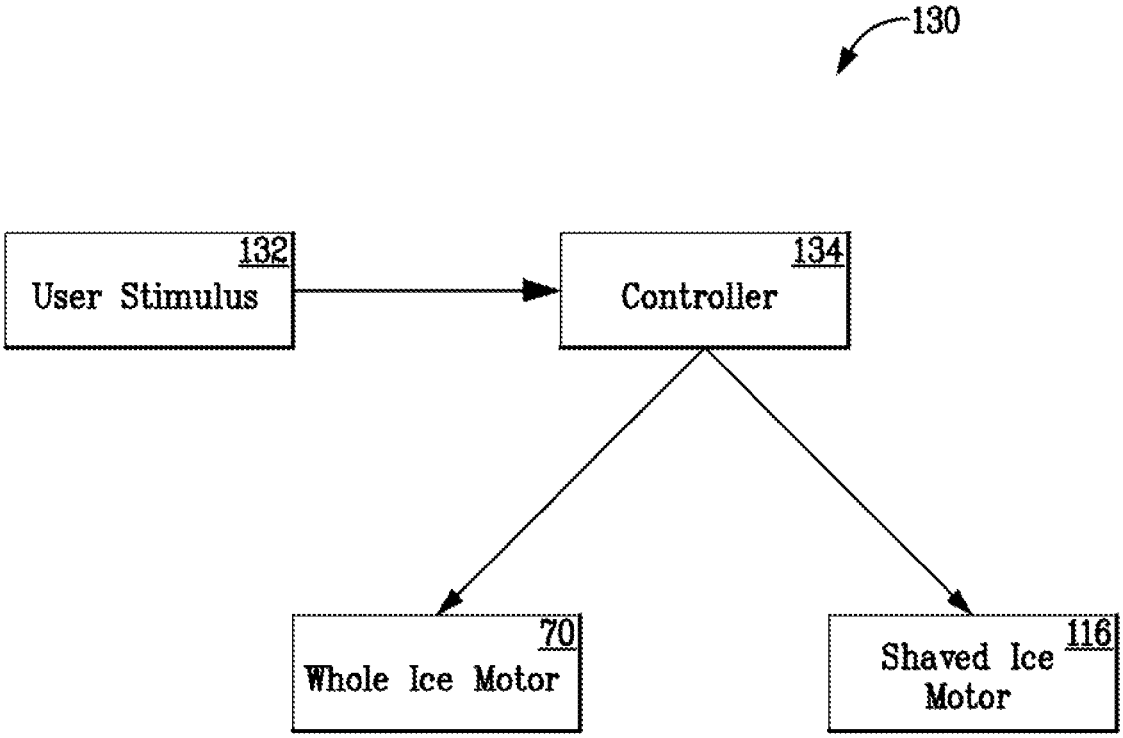
FIG. 9 is a block diagram showing another exemplary ice dispenser control system.

FIG. 9 is a block diagram of exemplary ice dispenser control system 130. Ice dispenser control system 130 includes whole ice motor 70, shaved ice motor 116, a controller 134 and a user stimulus 132. The method of controlling whole ice motor 70 and shaved ice motor 116 is inputted into controller 134, for example, by programming into memory of an application specific integrated circuit (ASIC) or other programmable memory device.

Controller 134 controls the operation of whole ice motor 70 and shaved ice motor 134 based on user stimulus 132, creating a user actuated dispensing system. If user stimulus 132 is a stimulus to receive shaved pellet ice, shaved ice motor 116 will rotate shaved ice gear 118, shaved ice axle 117, shaved ice sweep arm 112 and scraper blade 108 to deliver ice stored in ice tank 106 and deliver shaved pellet ice 114 to ice dispenser outlet 53 (as seen in FIG. 7). The user actuated dispensing system can also include the ability to dispense whole ice cubes to a user by controlling the whole ice motor 70. If user stimulus 132 is a stimulus to receive whole ice cubes, whole ice motor 70 will rotate whole ice axle, sweeper blades 66 and vertical, whole ice auger 64 to move whole ice cubes 62 from ice storage bin 38 to ice dispenser outlet 53 (as seen in FIG. 3).

An ice dispenser assembly is provided which provides cubed ice and shaved, pellet ice in an efficient and reliable manner. Consumer demand is met for shaved pellet ice and/or an ice and liquid slurry being dispensed from a refrigerator. Consumer demand is also met for a combination of shaved pellet ice, an ice and liquid slurry, and/or whole ice cubes being dispensed from a refrigerator.

The fundamental novel features of the invention as applied to various specific embodiments thereof have been shown, described and pointed out, it will also be understood that various omissions, substitutions and changes in the form and details of the devices illustrated and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An apparatus comprising:

a compartment;

an ice storage bin positioned in the compartment and configured to store whole ice cubes therein; and a pellet ice dispenser comprising:

a first motor stationarily disposed relative to the compartment;

a first axle drivingly connected to a shaft of the first motor;

a first ice cube auger drivingly connected to the first axle;

a blade stationarily disposed relative to the compartment and downstream of the first ice cube auger and configured to shave whole ice cubes into ice pieces; and an ice pelleter comprising:

an extrusion die stationarily disposed relative to the compartment and disposed downstream of the blade; and a shaved ice auger drivingly connected to the first axle, disposed between the blade and the extrusion die, and configured to move and compress the ice pieces through the extrusion die to form pellet ice.

2. The apparatus of claim 1, wherein the ice pelleter further comprises a sweep arm drivingly connected to the first axle, disposed downstream of the extrusion die, and configured to separate the pellet ice from the extrusion die.

3. The apparatus of claim 1, further comprising a whole ice cube dispenser disposed in the compartment, the whole ice cube dispenser comprising:

a second motor stationarily disposed relative to the compartment;

a second axle drivingly connected to a shaft of the second motor;

sweeper blades disposed in the compartment and drivingly connected to the second axle; and a second ice cube auger drivingly connected to the second axle, disposed upstream of the sweeper blades, and configured to move whole ice cubes from the ice storage bin toward the sweeper blades.

4. The apparatus of claim 1, wherein the extrusion die is heated.

5. The apparatus of claim 1, wherein the blade is disposed between the first ice cube auger and the shaved ice auger.

6. The apparatus of claim 1, wherein the shaved ice auger is disposed in a close proximity to the extrusion die.

7. The apparatus of claim 1, wherein the apparatus is a refrigerator, the compartment being positioned in, and thermally insulated relative to, a fresh food compartment of the refrigerator.

8. The apparatus of claim 1, wherein the apparatus is a refrigerator, the compartment being a freezer compartment of the refrigerator.

9. The apparatus of claim 1, wherein the shaved ice auger is a bar shaped member that comprises inclined faces facing the extrusion die.

10. The apparatus of claim 9, wherein the bar shaped member further comprises a middle portion drivingly connected to the first axle.

* * * * *